US005193243A

United States Patent [19]

Stegens

[11] Patent Number: 5,193,243

[45] Date of Patent: Mar. 16, 1993

[54] BRUSHROLL

[75] Inventor: Alfred H. Stegens, Cleveland, Ohio

[73] Assignee: The Scott Fetzer Company, Westlake, Ohio

[21] Appl. No.: 887,420

[22] Filed: May 20, 1992

Related U.S. Application Data

[63] Continuation of Ser. No. 456,348, Dec. 26, 1989, abandoned.

[51] Int. Cl.[5] ..... A46B 13/02

[52] U.S. Cl. ..... 15/179; 15/41.1; 15/391; 15/392; 384/489; 492/29; 492/47

[58] Field of Search ..... 15/41.1, 42–46, 15/48, 48.1, 48.2, 179, 182, 383, 384, 389, 391, 392; 29/110, 120, 123; 198/496; 384/489

[56] References Cited

U.S. PATENT DOCUMENTS

| | | | |
|---|---|---|---|
| 600,413 | 3/1898 | Drew | 15/41.1 |
| 1,104,270 | 7/1914 | Pack | 384/489 |
| 1,286,321 | 12/1918 | Hoover | 15/179 |
| 1,599,991 | 9/1926 | Demaree | 15/182 |
| 1,680,741 | 8/1928 | Lang | 384/489 |
| 1,681,453 | 8/1928 | Wright | 15/179 |
| 1,878,856 | 9/1932 | Jones | 15/179 |
| 1,973,679 | 9/1934 | Bass | 15/392 |
| 1,999,696 | 4/1935 | Kitto | 15/179 |
| 2,263,762 | 11/1941 | Dow et al. | 15/392 |
| 2,271,553 | 2/1942 | Smellie | 15/182 |
| 2,281,863 | 5/1942 | Smellie | 15/182 |
| 2,372,404 | 3/1945 | Taylor | 15/383 |
| 2,734,211 | 2/1956 | Vance | 15/182 |
| 3,521,932 | 7/1970 | Beebe | 344/489 |
| 3,566,497 | 3/1971 | Hamlen | 29/123 |
| 3,959,847 | 6/1976 | Kaulig et al. | 15/392 |
| 4,373,759 | 2/1983 | Greener et al. | 384/489 |
| 4,403,372 | 9/1983 | Keane et al. | 15/391 |

FOREIGN PATENT DOCUMENTS

| | | | |
|---|---|---|---|
| 1012107 | 7/1952 | France | 384/489 |
| 671202 | 10/1964 | Italy | 29/110 |
| 390746 | 8/1965 | Switzerland | 29/123 |
| 2628 | of 1898 | United Kingdom | 15/41.1 |
| 27325 | of 1907 | United Kingdom | 15/41.1 |
| 1206844 | 9/1970 | United Kingdom | 29/110 |
| 2086717 | 5/1982 | United Kingdom | 15/182 |

*Primary Examiner*—Harvey C. Hornsby
*Assistant Examiner*—Mark Spisich
*Attorney, Agent, or Firm*—Watts, Hoffmann, Fisher & Heinke

[57] ABSTRACT

A brushroll having a spindle and a pair of end assemblies each including a thread guard, a shouldered stub shaft, a bearing and an end cap. The thread guards each include a pair of radially spaced annular wall portions which define channels opening outward from the spindle. The end caps have peripheral walls which extend into the channels defined by the thread guards to prevent threads loosened by the brushroll from fouling the brushroll bearings. Spools formed in the end caps cvapture threads flowing outwardly along the brushroll to prevent the threads from working their way back to the bearing. In a preferred construction, the spindle carries tufts which are angled toward the ends of the spindle in order to encourage the flow of threads toward the ends of the spindle. The brushroll assembly is particularly suited for use with a wooden spindle since the thread guard and the stub shaft synergistically combine to retain the end assembly against the spindle even if the end spindle expands or contracts due to changes in ambient humidity.

5 Claims, 2 Drawing Sheets

BRUSHROLL this is a continuation of copending application Ser. No. 07/456,348 filed on Dec. 26, 1989, abandoned.

TECHNICAL FIELD

The present invention relates generally to vacuum cleaners, and more specifically to a vacuum cleaner brushroll characterized by a new and improved thread guard for preventing fouling of the brushroll bearings by threads picked up from the carpet.

BACKGROUND ART

Prior art brushrolls generally include a central spindle supported at either end by sleeve bearings mounted on the sides of the nozzle. The spindles are turned by belts tied to a vacuum cleaner motor, either directly or through one or more pulleys. Mounted on the elongated surface of the spindle is a plurality of tufts of bristles or beater bar elements projecting normally from the surface of the spindle. As the brushroll rotates, the tufts or beater bar elements brush against the surface of the carpet and loosen dirt from the fibres. The tufts or beater bar elements are generally mounted in a helical pattern on the brushroll so as to agitate the carpet seriatim as the vacuum cleaner moves over the carpet surface.

In practice, dirt and threads loosened by the brushroll can flow along the surface of the roll toward its ends into the sleeve bearings at the sides. As a result, the bearings can foul so that the brushroll cannot turn freely in response to the belt drive.

A number of thread guards have been proposed for preventing threads from fouling the brushroll bearings. These proposed thread guards include labyrinth seals which fit over the ends of the spindle in an effort to prevent threads moving outward along the spindle from reaching the bearing. In one proposed seal, a disc-like guard includes an annular flange and radial skirt directed into an annular slot in the end of the spindle so as to form a labyrinth between the guard and the slot. One drawback to this proposed seal is that the labyrinth opens axially toward the spindle, so that thread moving outwardly along the brushroll will flow naturally into the labyrinth rather than outside and past the seal. Another drawback is that threads may collect in the annular slot, so that the seal itself may foul, inhibiting the free rotation of the brushroll. Once fouled, the end assembly of the brushroll may have to be disassembled in order to reach and remove the threads collected in the slot.

Another proposed brushroll features a spindle having a cylindrical cavity on one end. A sleeve mounted on the side of the nozzle forms an annular slot directed axially inwardly into which the end of the spindle extends to form a labyrinth. As with the previous proposed seal, this proposed labyrinth seal opens axially toward the center of the spindle so that threads flowing outwardly along the spindle may work their way into the seal.

SUMMARY OF THE INVENTION

The present invention provides a vacuum cleaner brushroll assembly which prevents threads picked up during cleaning from fouling the brushroll bearing. The brushroll consists of a spindle supported at each end by an assembly including a thread guard, a shouldered stub shaft, a bearing and an end cap. The thread guards each include a pair of annular wall portions which are spaced apart to define a channel which opens axially outward of the adjacent end of the spindle. The end caps each include peripheral walls which extend into the channels defined by the adjacent thread guards in order to define labyrinth seals. An important feature of the labyrinth seals formed by the thread guards and the end caps is that the seals open axially away from the spindle so that threads working their way axially along the spindle will pass over the seal and flow outwardly toward the end cap.

A preferred brushroll also includes tufts carried by the spindle. Each tufts mounted on the spindle is angled toward one end of the spindle or the other to encourage the flow of threads towards the ends of the spindle. Furthermore, an especially preferred brushroll includes spools axially outward of the thread guards for capturing pieces of thread which flow outward over the thread guard. Since the spool is located outward of the thread guard, it is easily accessible for removing the captured threads.

Another important feature of the preferred brushroll is that the thread guards and shafts synergistically combine to hold each other in engagement with a wooden spindle. The second, i.e. inner, annular wall portions of the thread guards are sized so as to embrace the ends of the spindle. The stub shafts fit into holes in the ends of the spindle.

Wooden spindle expand or contract with changes in ambient moisture. Unrestrained contraction or expansion of the end portions of the spindle could loosen either a ferrule or an inserted stub. In the arrangement of the present invention, however, the second annular wall portions of the thread guards prevent the end portions of the spindle from expanding so as to loosen the stub shafts, while the stub shafts prevent the end portions of the spindle from contracting so as to loosen the thread guards. The stub shafts include shoulders which press against central web portions of the thread guards so as to press and capture the thread guards against the ends of the spindle. Thus, the thread guards prevent the stub shafts from separating from the spindle, while being held in place by the shoulders of the shafts.

In a modified embodiment most useful with plastic spindle, each thread guard and stub shaft are injection molded as a unit. In this modified embodiment, the stub shafts include shoulders which mount pairs of radially spaced annular wall sections As with the preferred embodiment, the end caps each include peripheral walls which extend into the channels defined between the annular wall portions in order to define labyrinth seals.

Still other features and advantages and a full understanding of the invention will become apparent to those skilled in the art from the following description of the preferred embodiment of the invention and the accompanying drawings.

DETAILED DESCRIPTION OF THE DRAWING

Figure 1:
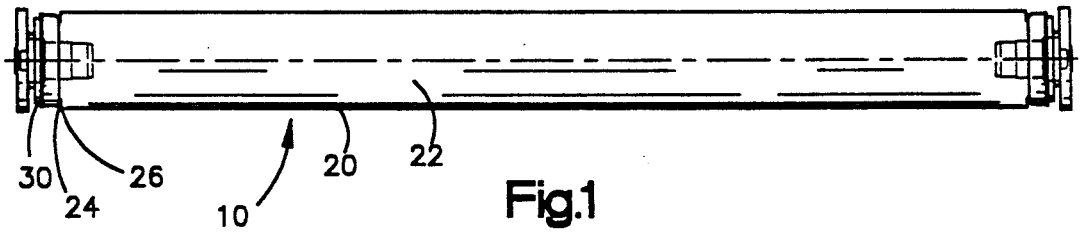
FIG. 1 is a side elevational view showing a preferred brushroll according to the present invention with tufts omitted for clarity.

A brushroll 10 according to the present invention is illustrated in FIG. 1. As shown in FIG. 1, the brushroll 10 consists of a spindle 20 rotatably supported at each end by end assemblies 30. Each end assembly 30 is mounted on a vacuum cleaner nozzle (not shown) to position the brushroll 10.

In a preferred embodiment, the spindle 20 is made of wood and consists of a main portion 22 and two reduced diameter portions or necks 24 at either end of the spindle 20. The necks 24 meet the main portion 22 to form shoulders 26. A round blind hole 28 is drilled into each end of the spindle 20.

Figure 2:
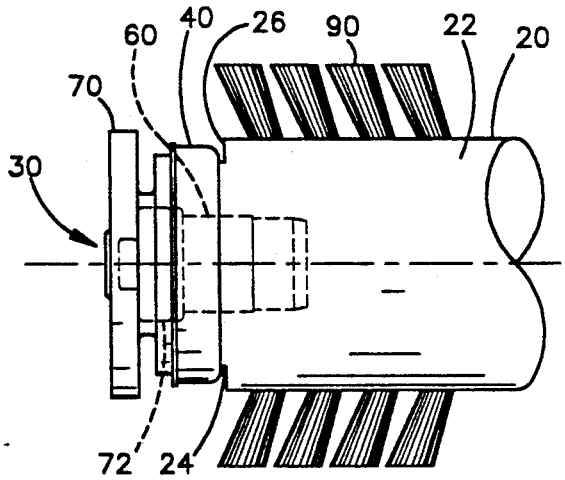
FIG. 2 is an enlarged fragmentary elevational view of one end of the brushroll of FIG. 1.
Figure 3:
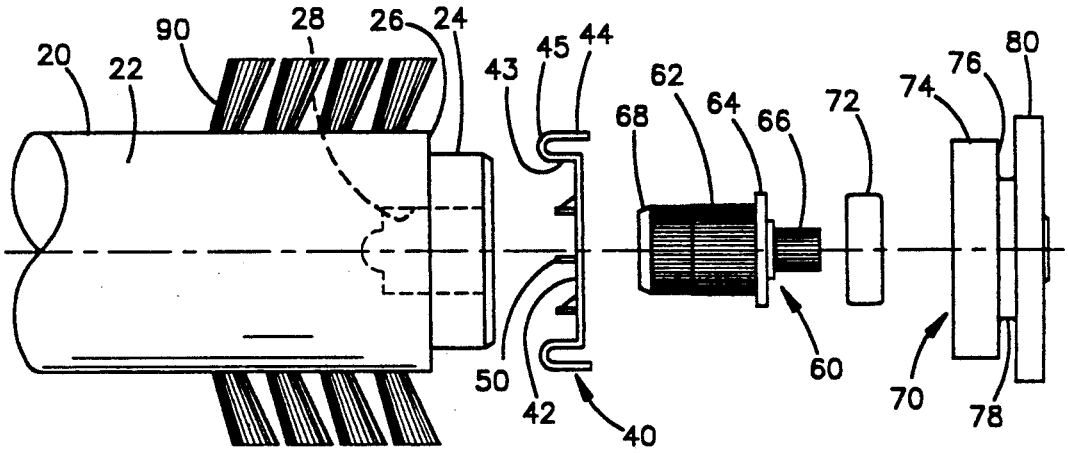
FIG. 3 is an exploded view of one end of the brushroll of FIG. 1.
Figure 4:
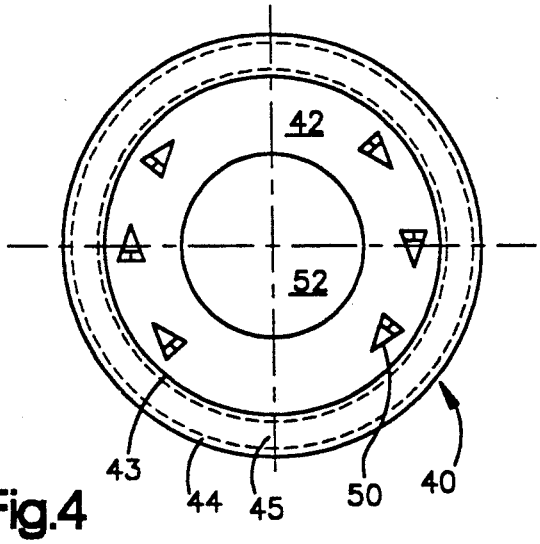
FIG. 4 is an end elevational view of a preferred thread guard according to the present invention.

As best shown in FIGS. 2 and 3, each end assembly 30 according to the present invention comprises a thread guard 40, a shouldered stub shaft 60, a bearing 72 and an end cap 70. The preferred thread guard or ferrule 40 as shown in FIGS. 3 and 4 is a steel stamping comprising a central web portion 42 and a pair of annular wall portions 43, 44. The inner annular wall portion 43 is bent at 90° to the central web portion 42, and is joined by a flange 45 to the reversely bent, outer annular wall portion 44. The annular wall sections 43, 44 are radially spaced to define an annular channel formed between the annular wall portions 43, 44. The inner annular wall portions 43 fit over the necks 24 at either end of the spindle 20 and are held in place by tangs 50 cut out from the central web portion 42. A hole 52 is formed in the central web portion 42 and aligns with the hole 28 when the thread guard is fitted or the adjacent neck 24.

The stub shaft 60 shown in FIG. 3 is an integral steel member comprising a main portion 62, a shoulder 64 and a reduced diameter end portion 66. The main portion 62 is sized to form a close fit when pushed into the hole 28 in the spindle 20. The surface of the main portion 62 is knurled in order to increase the frictional engagement between the main portion 62 and the hole 28. Likewise, the reduced diameter end portion 66 is preferably knurled. A forward portion 68 of the main portion 62 is preferably tapered in order to center the shaft 60 with the spindle 20 when the main portion 62 is pushed into the hole 28.

During assembly, the thread guard 40 is forced over the neck 24 of the spindle 20 and the main portion 62 of the shaft 60 is pressed into the hole 28. The shoulder 64 of the shaft 60 has a larger diameter than the hole 52 in the thread guard 40 and holds the thread guard 40 against the adjacent neck 24 of the spindle 20. At the same time, the annular wall portion 43 of the thread guard 40 surrounds the neck 24 of the spindle 20 so that the main portion 62 remains in frictional engagement with the bore 28 if the adjacent neck 24 expands.

Figure 5:
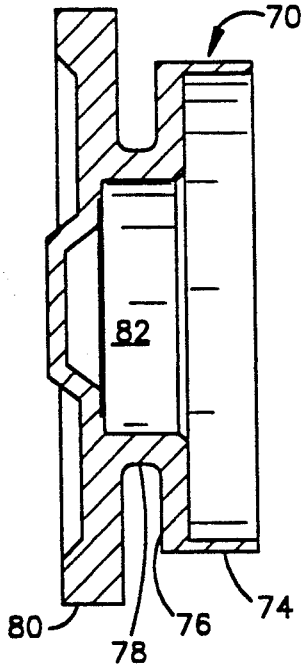
FIG. 5 is an enlarged cross-sectional view of an end cap that forms part of the present invention.

Outward of the thread guard 40 is the end cap 70. The end cap 70 as shown in FIG. 5 is a unitary plastic molding comprising a peripheral wall 74, an inner flange 76, a spool 78 and an outer flange 80. The peripheral wall 74 is of a suitable axial length to extend into the channel of the adjacent thread guard 40. The outer race of the ball bearing 72 is press fitted into a hollow portion 82 in the end cap 70 and the knurled end portion 66 of the stub shaft 60 is press fitted into the inner race of the ball bearing 72 in order to provide support for the spindle 20 and the thread guard 40.

The first annular wall portion 44 of the thread guard 40 has substantially the same outer diameter as the main portion 22 of the spindle 20 so that threads working their way axially outward flow over the thread guard 40 and the peripheral wall 74 of the end cap 70 into the spool 78. Threads flowing into the spool 78 are trapped on the spool 78 and prevented from flowing back toward the seal formed by the thread guard 40 and the end cap 70 by the inner flange 76. The threads trapped on the spool 78 may be removed during routine maintenance of the vacuum cleaner.

The brushroll 10 featuring the end cap 70 as illustrated in FIG. 5 is mounted on a vacuum cleaner nozzle (not shown) by sliding the outer flange 80 into slots on the side of the nozzle. In operation, the brushroll 10 is driven by a belt (not shown) which may engage a slot (not shown) on the brushroll 10.

In a preferred brushroll, the spindle 20 carries two helical rows of tufts 90 which agitate the carpet as the brushroll 10 turns in order to loosen dirt in the carpet. Preferred tufts 90 as shown in FIGS. 2 and 3 are angled toward the ends of the dowel 20 to encourage the flow of threads toward the spools 78 at either end of the brushroll 10.

Figure 6:
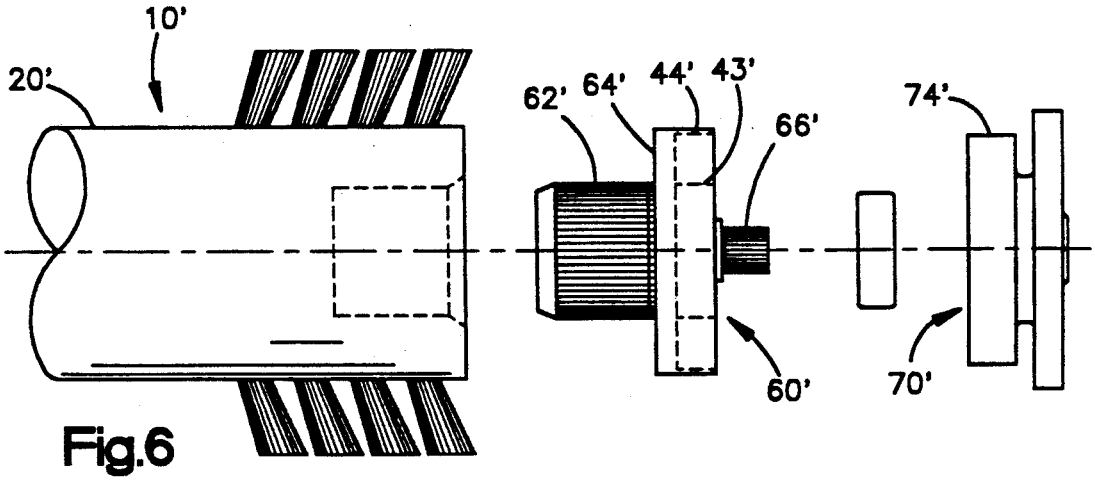
FIG. 6 is an exploded view of an end section of a modified brushroll assembly.

In a modified brushroll 10' designed for ease of construction when using a plastic spindle 20', the thread guard 40 and stub shaft 60 are combined. As shown in FIG. 6, a modified stub shaft 60' is an injection molding which comprises a main portion 62', a shoulder 64' and a reduced diameter end portion 66'. The shoulder mounts a pair of radially spaced annular wall portions 43', 44' which define an annular channel. The end cap 70' of the modified brushroll 10' has the same structure as the end cap of the preferred brushroll 10 of FIGS. 1, 2 and 3. When assembled, a peripheral wall 74' projecting from the end cap 70' extends into the channel defined by the annular wall portions 43', 44' of the modified stub shaft 60' to form a labyrinth seal.

Figure 7:
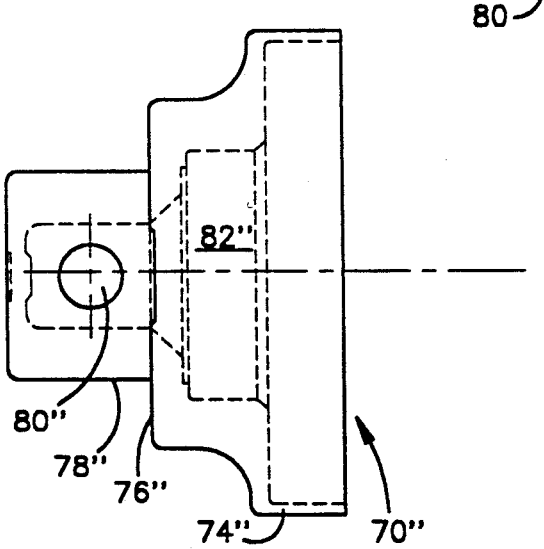
FIG. 7 is a side elevational view of a modified end cap.

A modified end cap 70" for use with either the preferred brushroll 10 of FIGS. 1, 2 and 3 or the modified brushroll 10' of FIG. 6 is shown in FIG. 7. The modified end cap 70" comprises a peripheral wall 74", an inner flange 76", a spool 78" and stop screw 80". When assembled, a bearing such as the ball bearing 72 of FIG. 3 may be press fitted into a hollow portion 82" of the modified end cap 70" and the peripheral wall 74" extends into a channel such as the channel defined by the thread guard 40 in FIG. 3. Threads working axially outward along the brushroll 10 or 10' flow over the peripheral wall 74" into the spool 78" and are trapped behind the stop screw 80". The trapped threads are then retained on the spool 78" between the inner flange 76" and the stop screw 80" until removed.

Many variations and modifications of the invention will be apparent to those skilled in the art from the above detailed description. Therefore, it is to be understood that, within the scope of the appended claims, the invention can be practiced otherwise than as specifically shown and described.

I claim:

1. A brushroll comprising a spindle having a central axis and a pair of end assemblies for rotatably supporting said spindle, one of said end assemblies comprising:

a) a thread guard fixed at one end of said spindle having inner and outer annular wall portions defining a channel, said annular wall portions and channel being coaxial with said spindle and said channel opening axially outwardly from said spindle;

b) a shaft coaxial with the central axis of said spindle; and c) means including an end cap supporting said shaft, said end cap including an inner flange and a peripheral wall portion, said inner flange having a diameter intermediate between diameters of said inner and outer annular wall portions of said thread guard and said peripheral wall portion extending axially inwardly from a periphery of the inner flange into said channel defined by the inner and outer annular wall portions of said thread guard so as to form a labyrinth seal opening axially outwardly from said spindle;

d) wherein i) the inner annular wall portion of said thread guard surrounds said end portion of said spindle and said thread guard includes a central web portion abutting said end of said spindle from the inner annular wall portion toward the central axis of said spindle;

ii) said shaft passes through a hole in said central web portion of said thread guard and frictionally engages a hole in said end of said spindle, said shaft having a shoulder facing axially inwardly with respect to said spindle for pressing the central web portion of said thread guard against said end of said spindle.

2. An end assembly for a brushroll including a spindle comprising:

a) a thread guard coupleable to one end of said spindle having inner and outer annular wall portions defining a channel to open axially outwardly from such spindle;

b) a shaft for rotation with such spindle; and c) means including an end cap supporting said shaft, said end cap including an inner flange and a peripheral wall portion, said inner flange having a diameter intermediate between diameters of said inner and outer annular wall portions of said thread guard and said peripheral wall portion extending axially inwardly from a periphery of the inner flange into said channel defined by the inner and outer annular wall portions of said thread guard so as to form a labyrinth seal opening axially outwardly from such spindle;

d) wherein i) the inner annular wall portion of said thread guard is constructed and arranged to surround said end of such spindle and said thread guard includes a central web portion abutting said end of said spindle from the inner annular wall portion toward a central axis of such spindle; and ii) said shaft passes through a hole in said central web portion of said thread guard for frictional engagement with a hole in said end of such spindle, said shaft having a shoulder facing axially inwardly with respect to said spindle for pressing the central web portion of said thread guard against said end of such spindle.

3. The vacuum cleaner brushroll including a tufted spindle supported by end assemblies at opposite ends of said spindle having bearings that rotatably mount said spindle in a vacuum cleaner nozzle, whereby rotation of the spindle is effective to pick up dirt, lint, threads and the like that tend to move along said spindle toward said bearings at its end, the improvement wherein each of said end assemblies comprises a first member fixed to said brush roll so as to rotate therewith, a second member rotatable relative to said first member and having a portion that is adapted to mate with brushroll mounting structure of the vacuum cleaner nozzle, said members including wall portions that cooperate to define a labyrinth seal, a stub shaft having a portion fixed in an end of said spindle and a collar that engages said first member to hold it against said end of said spindle, and a bearing having one portion fixed to said stub shaft and a second portion fixed in said second member and rotatable with respect to the stub shaft, said bearing being surrounded by said labyrinth seal to protect it from material picked up by rotation of said spindle.

4. In a vacuum cleaner brushroll including a tufted spindle supported by end assemblies at opposite ends of said spindle having bearings that rotatably mount said spindle in a vacuum cleaner nozzle, whereby rotation of said spindle is effective to pick up dirt, lint, threads and the like that tend to move along said spindle toward said bearings at its ends, the improvement wherein each of said end assemblies comprises a first member fixed to an end of said spindle so as to rotate therewith, a second member rotatable relative to said first member and having a bearing cavity and a portion that is adapted to mate with brush roll structure in the vacuum cleaner nozzle, one of said members having a pair of annular walls that are radially spaced apart to define an annular channel, the other of said members having an annular skirt that extends into said annular channel of said one member to form a labyrinth thread seal, a stub shaft extending through said one member into fixed engagement with said end of said spindle, said stub shaft having a collar that engages said first member to hold it against said one end of said spindle, and a bearing having a portion fixed to said stub shaft and a second portion fitted in said bearing cavity and rotatable with respect to the stub shaft, said bearing being surrounded by said labyrinth seal to protect it from material picked up by rotation of said spindle.

5. The improvement of claim 4 wherein said one member having said pair of annular walls in said first member and said other member having said annular skirt is said second member.

* * * * *

UNITED STATES PATENT AND TRADEMARK OFFICE

CERTIFICATE OF CORRECTION

PATENT NO. : 5,193,243

DATED : March 16, 1993

INVENTOR(S) : Alfred H. Stegens

It is certified that error appears in the above-identified patent and that said Letters Patent is hereby corrected as shown below:

Column 4, line 65, insert --coaxial-- before "end".

Column 5, line 33, "said" should read --such--.

Column 6, line 6, "The" should read --In a--.

Column 6, line 12, "end" should read --ends--.

Column 6, line 22, "to" should read --on--.

Column 6, line 38, insert --mounting-- after the word "roll".

Column 6, line 48, "to" should read --on--.

Column 6, line 54, "in" should read --is--.

Signed and Sealed this

Sixteenth Day of November, 1993

*Attest:*

Bruce Lehman

BRUCE LEHMAN

*Attesting Officer*

*Commissioner of Patents and Trademarks*